US006305459B1

(12) United States Patent
Van Reatherford et al.

(10) Patent No.: US 6,305,459 B1
(45) Date of Patent: Oct. 23, 2001

(54) METHOD OF MAKING SPRAY-FORMED ARTICLES USING A POLYMERIC MANDREL

(75) Inventors: Larry Van Reatherford, Clarkston; Oludele Olusegun Popoola, Novi, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/370,299

(22) Filed: Aug. 9, 1999

(51) Int. Cl.[7] ..... B22D 23/00; B21K 1/24
(52) U.S. Cl. ..... 164/46; 164/465; 29/890.122
(58) Field of Search ..... 164/46, 465; 29/890.122, 29/527.6, 527.2

(56) References Cited

U.S. PATENT DOCUMENTS

| | | | | |
|---|---|---|---|---|
| 3,340,084 | * | 9/1967 | Eisenlohr | 427/192 |
| 4,424,953 | * | 1/1984 | Takagi et al. | 251/368 |
| 4,671,491 | * | 6/1987 | Kurioishi et al. | 251/368 |
| 5,021,259 | | 6/1991 | Singelyn . | |
| 5,060,713 | * | 10/1991 | Reichelt et al. | 164/46 |
| 5,074,256 | | 12/1991 | Saito . | |
| 5,110,631 | * | 5/1992 | Leatham et al. | 427/422 |
| 5,126,529 | * | 6/1992 | Weiss et al. | 219/121.6 |
| 5,434,210 | | 7/1995 | Rangaswamy et al. . | |
| 5,464,486 | | 11/1995 | Rao . | |
| 5,505,988 | * | 4/1996 | Tanskanen et al. | 427/163.2 |
| 5,592,927 | * | 1/1997 | Zaluzec et al. | 123/668 |
| 5,658,506 | * | 8/1997 | White et al. | 264/28 |
| 5,660,934 | | 8/1997 | Longo . | |
| 5,766,690 | | 6/1998 | Derby et al. . | |
| 5,817,267 | * | 10/1998 | Covino et al. | 264/219 |
| 5,829,404 | | 11/1998 | Mori et al. . | |
| 5,837,048 | | 11/1998 | Kelley . | |
| 5,983,495 | * | 11/1999 | Popoola et al. | 29/890.122 |

* cited by examiner

*Primary Examiner*—Tom Dunn
*Assistant Examiner*—Kevin P. Kerns
(74) *Attorney, Agent, or Firm*—Damian Pocari; William J. Coughlin

(57) ABSTRACT

Method of making valve seats by thermally spraying bulk material. The method includes the steps of: (i) preparing a cylindrical polymeric mandrel having an outside dimension not greater than the desired inside dimension of the desired insert, the mandrel having no means to provide for separation of the sprayed material from the mandrel, (ii) thermal spraying separate particles of one or more types of steel or nickel alloys in the presence of a controlled oxidizing medium under conditions that allow firstly, melting of the mandrel and its infiltration into the sprayed material and secondly to form a subsequent polymer free dense metallic bulk composite material (iii) after cooling, machining and cutting into discrete seat shapes for implanting into the final product.

16 Claims, 2 Drawing Sheets

METHOD OF MAKING SPRAY-FORMED ARTICLES USING A POLYMERIC MANDREL

BACKGROUND OF THE INVENTION

1. Technical Field

The present invention relates to the method of making hollow articles by the process of thermal spraying molten metal particles. More particularly, the process relates to the use of a plastic mandrel that is melted during the thermal spraying process.

2. Discussion of the Prior Art

Valve seats inserts (valve seats) have been used to strengthen the physical characteristics of certain parts of a component, particularly components in internal combustion engines. For example, steel alloy valve seats are used extensively in aluminum engine heads and in some high-performance or alternative fuel cast iron engine heads. The list of enhanced high-performance characteristics desired at the valve seat is quite long, including increased ambient and high temperature wear resistance, higher creep resistance, higher thermal fatigue strength, (under repeated valve impact loading), good thermal conductivity, better corrosion resistance, lower manufacturing costs, and capability of being tribologically compatible with valve materials engaging the valve insert.

A common manufacturing approach that attempts to attain these characteristics is to make the valve seats by powder metallurgy processes which involve several steps: weighing and blending of selected powder mixtures; compaction and green body formation in molds and dies; sintering and sometimes copper infiltration of the compact at respectively 1500° C. and 1080° C.; controlled cooling; post-sintering tempering heat treatment; and finally machining to the desired seat dimensions. This obviously is an involved process which adds considerable cost. To achieve the desired physical characteristics, chemical additions are made to the powder mixture of carbon, chromium, molybdenum (for wear resistance), cobalt and nickel (for heat resistance), and other additions to obtain better thermal conductivity or better self-lubrication. In ferrous based powder mixtures, the resulting product may have its matrix consist of pearlite, bainite or tempered martensite depending on the heat treatment used during compacting and sintering. The sintered insert will always have the same chemistry as the starting green compact with its micro-structure dependent on the heat treatment employed.

To obtain more optimum physical characteristics for the valve seats, very high concentration of certain additions (i.e. 15–25% wt. Cobalt; up to 20% wt. Pb) may be necessary, as well as the introduction of certain chemical ingredients, such as rare earths, which, unfortunately, inhibit or prevent sintering by powder metallurgy techniques. moreover, powder metallurgy does not allow the introduction of low cost oxides or ceramics during processing; ceramics are very useful to achieve certain of the physical characteristics.

When an engine is run with alternate fuels such as natural gas or alcohol, powder metal valve seats for internal combustion engine heads are often inadequate. Powder metal valve seats, when used for intake valve seats in alternate-fuel engines, often contain too little self-lubricant, such as molybdenum disulfide or lead, and thus prematurely wear. Lead is also undesirable as an embedded self-lubricant since it can foul catalytic surfaces used in treating emissions. Moreover lead processing poses environmental concerns and is regulated in the United States.

Commonly assigned U.S. patent application Ser. No. 08/999247, titled METHOD OF MAKING SPRAY-FORMED INSERTS, filed Dec. 29, 1997, now U.S. Pat. No. 5,983,495, and incorporated herein by reference, teaches a method of making valve seats by applying a bulk material to a rotating hollow mandrel. The mandrel was aluminum or other material that did not melt from the heat of the thermal spray process. While this process produced acceptable valve seats, it required removing the insert from the mandrel or machining the mandrel from within the valve seat. Because the mandrel and valve seats were made from two dissimilar metals, the machining step required a complicated bimetallic machining process.

The present invention improves upon this method by using a polymeric mandrel that is melted during the thermal spray process. This eliminates the steps of removing the valve seat from mandrel and the bimetallic machining.

These and other problems of the related art are overcome by the present invention.

SUMMARY OF THE INVENTION

It is an object of this invention to provide a method to fabricate a ring-shaped article by spraying bulk material onto a polymeric mandrel. The method enables the fabrication of ring-shaped articles without the need to remove the article from the mandrel. The method includes the steps of preparing a hollow polymeric mandrel that has an exterior surface dimension not greater than the desired inner dimension of the article. The mandrel has an inner surface that receives a pressurized fluid. The fluid is used to both cool the mandrel during the thermal spray process and support the mandrel from collapse as it melts when the spray formed article forms during successive deposition of hot layers of molten metal particles.

The mandrel is rotated and molten metal particles are thermally sprayed onto the mandrel exterior surface. The first layer of molten metal particles heats and melts the exterior surface of the mandrel. A pressurized cooling fluid, such as air, is circulated through the interior surface of the mandrel to cool and support the mandrel The cooling fluid pressurizes the interior surface of the mandrel and prevents its collapse.

Successive layers of metal particles are applied atop the initial layer and the mandrel. The successive layers are generally hotter than the initial layer and cause the mandrel to further heat and soften. Heat from the successive layers causes the softened mandrel to melt. The successive layers are supported by the initial layer.

These and other desired objects of the present invention will become more apparent in the course of the following detailed description and appended claims. The invention may best be understood with reference to the accompanying drawings wherein illustrative embodiments are shown.

DETAILED DESCRIPTION AND BEST MODE

Figure 1A:
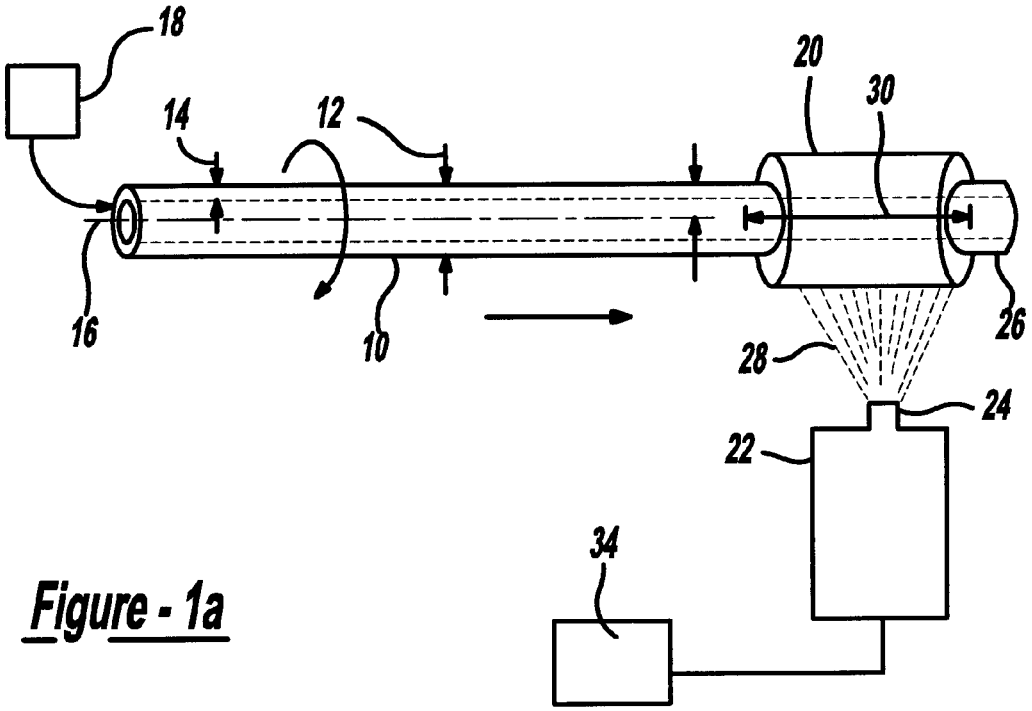
FIG. 1*a* is a schematic illustration of one apparatus mode for carrying out the thermal spraying step of this invention.

The invention will also be described as a method of manufacturing a valve seat for an internal combustion engine, however other components, especially ring-shaped components, may also be manufactured using the same or similar process, technique and equipment, and are included within the invention described herein.

Figure 1B:
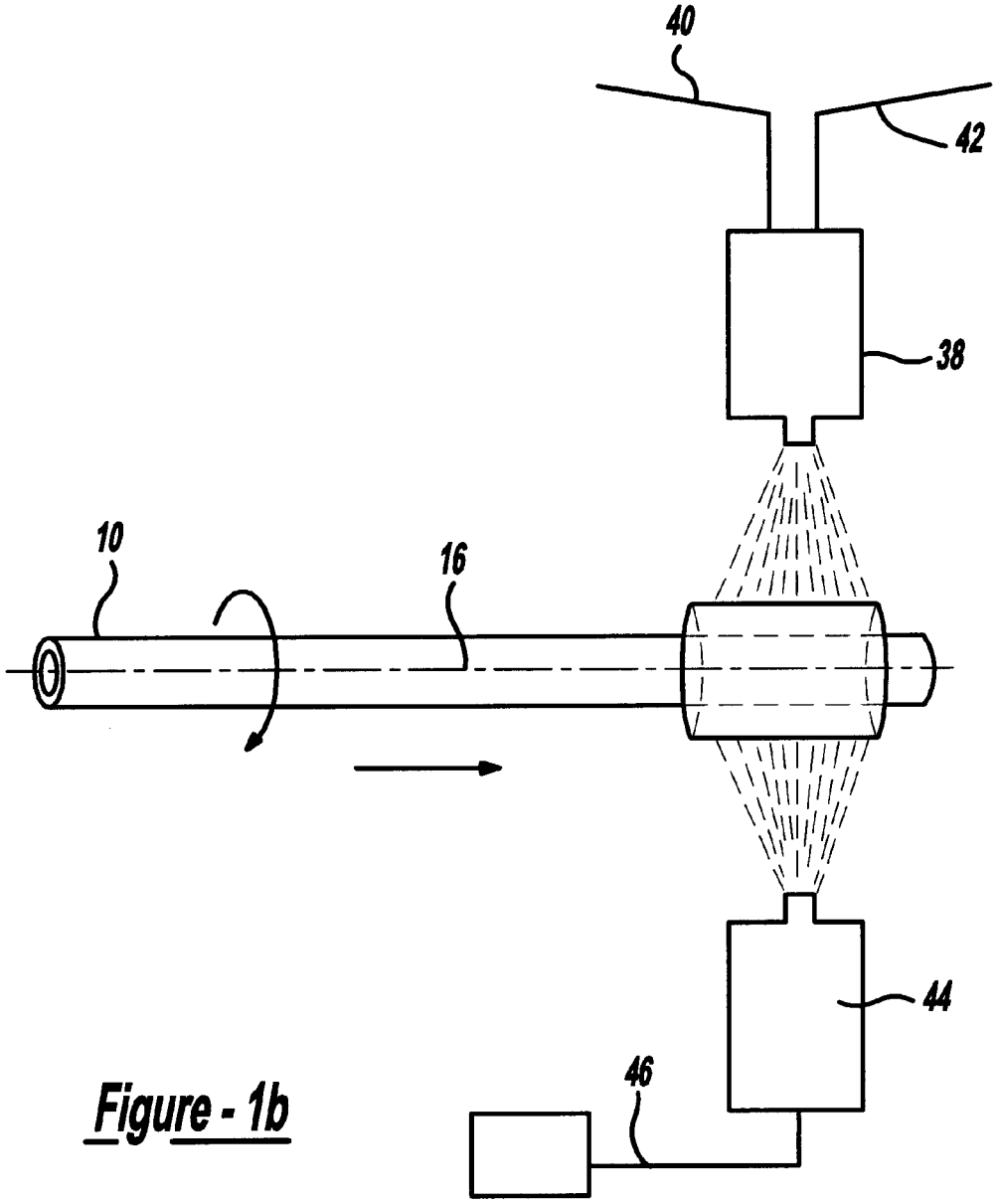
FIG. 1*b* is a schematic illustration of an alternative mode.

The following items are a word list of the items described in the drawings and are reproduced to aid in understanding the invention;

10 mandrel
12 mandrel outer diameter
14 mandrel thickness
16 axis of rotation
18 apparatus
20 sprayed bulk material
22 single wire thermal spray gun
24 spray head
26 target mandrel surface
28 molten droplet spray
30 length
32 layer thickness
34 wire feed supply
36 single feed wire
38 two wire thermal spray gun
40 first wire
42 second wire
44 thermal spray gun
46 feedstock
48 initial layer
50 ring-shaped article
52 inner surface
54 inner dimension
56 succeeding layers
58 ring-shaped sections The invention utilizes a novel plastic mandrel 10 as shown in FIGS. 1*a* and 1*b*. The mandrel 10 has an exterior surface dimension 12 that is not greater than the desired inner dimension of the ring-shaped article, such as a valve seat insert, to be fabricated. To make valve seat inserts for internal combustion engine heads, a variety of polymeric materials that are not heat hardenable are suitable for use as the mandrel including polyethylene and ethylene-propylene copolymer plastic materials. It is generally desirable to use polymeric materials having a melting temperature less than 400° C. The mandrel thickness 14 is selected so that the mandrel 10 can be completely melted during the thermal spraying operation. When using a polyethylene mandrel 10, a thickness of between 0.2 and 1.0 mm was found to provide sufficient strength to support the initial thermal spray layers while completely melting during succeeding application layers. In general, the mandrel exterior surface is grit blasted prior to thermal spray application to provide adhesion of initial spray layers.

The mandrel 10 is preferably rotated about its own central axis 16 at a speed in the range of 20–60 revolutions per second. Apparatus 18 is provided to pass cooling fluid, such as air or a liquid, through the interior of the mandrel 10. Typical air flow rate of about 20–100 cfm under 30–40 psi pressure is used during the thermal spray step.

Figure 2:
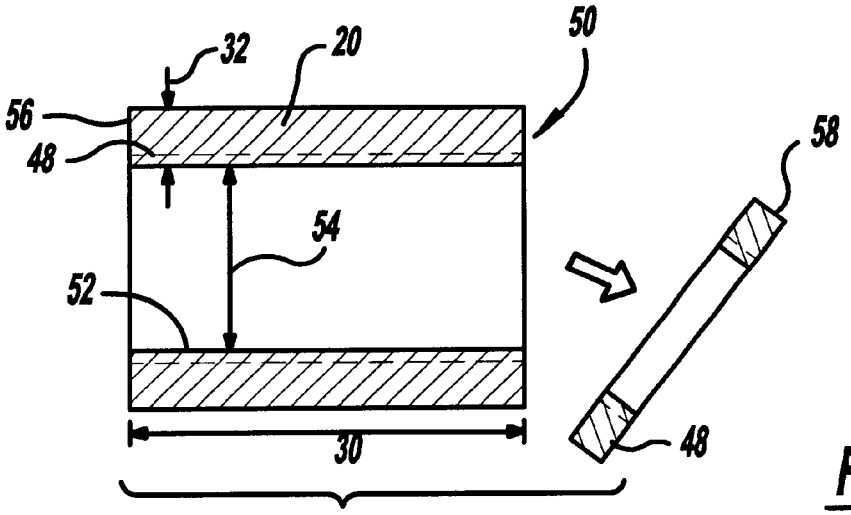
FIG. 2 is an enlarged view of a cylindrical bulk deposit made by this invention, the deposit being sliced into individual valve seats.

The next step involves thermal spraying bulk material onto the rotating mandrel 10. This creates or forms a sleeve of metal/metal oxide composite bulk material 20. The thermal spray technique may be wire arc, powder plasma, high velocity oxy-fuel. The thermal spray gun 22 has a spray head 24 advantageously placed about 6–12 inches from the target mandrel surface 26. As the mandrel 10 rotates, the thermal spray gun 22 emits a spray 28 of molten droplets that deposits a layer of bulk material on the mandrel surface 26 at a rate of about 2–10 lbs/hr. By repeatedly translating the gun back and forth across the length 30 of the mandrel (typically 1–5 feet), a layer thickness 32 (as shown in FIG. 2) of about ⅛–¼ inch can be built up in about 15 minutes. Alternatively, the mandrel 10 may be moved through a spray forming station in which several spray guns apply the coating to the work piece as shown in FIG. 1*b*.

The selection of the chemistry for the wire or powder feed supply 34 to the gun 22, to carry out thermal spraying, is less inhibited than that for powder metallurgy or the thermal spray process. Novel self-lubricating composite structures may be produced by (a) constituting a single wire feed 36 of steel or nickel alloy and (b) shrouding the sprayed hot molten droplets in a controlled air or oxygen atmosphere, to produce certain self-lubricating oxides of steel or nickel while the droplets are still in transit to the target or during the initial impact with the target. Details as to how to achieve the creation of self-lubricating oxides is taught in U.S. Pat. No. 5,592,927, the disclosure of which is incorporated herein by reference.

Other suitable materials include: (i) low carbon steel and wuestite (FeO) lubricant (2–15 wt. %); (ii) low carbon steel and high carbon steel and FeO lubricant (2–20 wt. %); and (iii) high carbon steel and nickel alloy, plus iron or nickel oxides. The low carbon steel may be a 1010 steel (such as a single wire feed 36 as shown in FIG. 1*a*) having a composition of by wt. % 0.1 C; 0.6 Mn; 0.045 P; 0.04 S; and the balance iron. The resulting spray-formed valve seat will consist of an iron alloy matrix inside of which is dispersed Fe oxides. The oxide content will vary between 2–15 wt. % depending on the nature of the propelling gas (air or nitrogen) that is used during the spray.

The second material may be applied by a use of two different wires that are fed into a two wire arc spray gun 38, as shown in FIG. 1*b*. The first wire 40 being the 1010 steel, and the second wire 42, being a high carbon steel having a composition of about 1.0 C, 1.6–2.0 Cr, 1.6–1.9 Mn, and the balance iron. The gun can be operated under a power of about 25–30 volts, 100–250 amps and a 60–100 psi air pressure. The valve seats formed in this case will have a hardness value ranging from 35–42 Rc (depending on the spray condition) with the oxide content being 2–20 wt. %. The third selection uses a high carbon steel wire as indicated above and a nickel based alloy wire containing 58% nickel, and 4% Nb, 10% Mo, 23% Cr and about 5% iron; the wires are fed as separate wire feed stocks in a two wire arc system, with the gun operated at a voltage of about 30–33 volts, 200–330 amps and 60–100 psi of air or nitrogen pressure. The valve seats produced with the third selection comprises various phases of nickel, iron, $Fe_3O_4$, NiO, FeO and has hardness values ranging from 40–50 Rc.

Copper may be introduced into the spray formed valve seat to increase the thermal conductivity and ability to extract heat from the valve. Spray-formed valve seats can have copper incorporated into the microstructure using another thermal spray gun 44 (as shown in FIG. 1*b*) to co-deposit the copper along with the deposit from the two wire arc gun 38 as referred to above; the additional thermal spray gun 44, of course uses a powder or wire copper feed stock 46. The amount of copper can be precisely controlled by adjusting the spraying parameters.

Method of Fabrication

Referring to FIG. 1*a* and FIG. 2, an initial layer 48 of bulk material 20 is applied atop the target mandrel surface 26 which has a thickness of between 0.1 to 0.5 millimeter. The molten metal droplet spray 28 causes the target mandrel surface 26 to heat and partially melt. The initial thermal spray layer 48 is applied to have a generally high porosity of between 5% and 20%. This enables the molten polymer from the mandrel 10 to flow into the interstices of the initial thermal spray layer 48. The metal spray/polymer melting/infiltration sequence continues until the polymeric mandrel is completely consumed to form layer 48. This polymer infiltrated metallic layer is soft, (hardness less than 70 Rb on Rockwell B scale) and comprises of regions of metal splats bonded together by polymeric phases. Typical thermal spray parameters to achieve volume porosity of 5%–10% with an average pore size of 30–50 micrometers and infiltration at this stage are voltage of 25–30V, current of 100–150A, line air pressure of 60 psi and flow rate of 30–40 cfm. Succeeding layers having porosity of 0.5–2% with pore sizes not bigger than 5 micrometers are formed by modifying the spray conditions to voltage of 25–30V, current of 250–300A, and air flow rate of 70–80 cfm.

The final article 50 is formed to have a thickness 32 of between 3 mm and 4 mm. The article 50 is then machined to have smooth interior surface 52. The polymer-metal initial layer 48 is easily machined because of its low hardness and good ductility.

For a valve seat insert, screw machining is used to simultaneously machine the internal and exterior surfaces, assure cylindricity, and cut the ring-shaped sections 58.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

What is claimed:

1. A method of making a ring-shaped article by spraying bulk material, comprising the steps of:

preparing a hollow polymeric mandrel having an exterior surface and an inner surface receiving a pressurized fluid;

thermally spraying molten metal particles onto said exterior surface of said mandrel; and applying a pressurized fluid to the inner surface of said mandrel, said particles melting said exterior surface of said plastic mandrel while said pressurized fluid both cools said mandrel and applies an internal pressure opposite to the force of said particles to resist the collapse of said mandrel from the heat and force of said particles.

2. The method of claim 1, further comprising the steps of cooling said article and retaining said article on said mandrel and cutting said article and mandrel axially into ring-shaped sections.

3. The method as in claim 1, wherein said article is a valve seat for an aluminum engine head.

4. The method as in claim 1, wherein said mandrel is a cylindrical member rotated relative to the thermal spray to build said metal particles as multiple coatings on said mandrel.

5. The method as in claim 1, wherein said mandrel is made from polyethylene.

6. The method as in claim 1, wherein said mandrel is made from ethylene-propylene copolymer.

7. The method as in claim 1, wherein said mandrel is melted by said thermal spraying step.

8. The method of claim 1, further comprising the steps of applying a first thermally sprayed layer of molten metal particles at a first temperature and after said first layer has solidified, applying succeeding thermally sprayed layers at higher temperatures, whereby said first thermally spray ed layer is supported by s aid plastic mandrel and said succeeding thermally sprayed layers are supported by said first thermally sprayed layer.

9. The method of claim 8, wherein said succeeding thermally sprayed layers heats and melts said mandrel.

10. The method of claim 1, further comprising rotating said mandrel during said thermal spraying step so that said metal particles are evenly distributed around said mandrel exterior surface.

11. The method of claim 1, wherein said molten metal particles partially melt said mandrel and form an initial layer having a porosity between 10 and 20% by volume and said molten polymer flows int o the interstices to form a metal-polymer composite layer that is easily machined.

12. A method of making a ring-shaped article by spraying bulk material, comprising the steps of:

preparing a hollow cylindrical polymeric mandrel having an. exterior surface and an inner surface receiving a pressurized fluid;

thermally spraying molten metal particles onto said exterior surface of said mandrel, said particles applying a force and transferring heat to said exterior surface and melting said mandrel, said particles forming an initial layer having a porosity between 10 and 20% by volume and said molten polymer flowing into the interstices to form a metal-polymer composite layer;

rotating said mandrel relative to said thermal spray particles to build said metal particles as multiple coatings on said mandrel; and applying a pressurized fluid to the inner surface of said mandrel; said particles softening said exterior surface of said plastic mandrel while said pressurized fluid both cools said mandrel and applies an internal pressure opposite to the force of said particles to resist the collapse of said mandrel from the heat and force of said particles.

13. A method of making a ring-shaped article by spraying bulk material, comprising the steps of:

preparing a hollow cylindrical polymeric mandrel having an exterior surface, said mandrel having an inner surface receiving a pressurized fluid;

spraying a first thermal spray layer of molten metal particles at a first temperature atop said exterior surface, said first thermally sprayed layer applying a force and transferring heat to said exterior surface and melting said polymeric mandrel, said first thermally sprayed layer having a porosity between 10 and 20% by volume and molten material from said polymeric mandrel flowing into the interstices to form a first metal-polymer composite layer; and applying succeeding thermally sprayed layers atop said first metal-polymer composite layer to form a succeeding layer having a porosity between 0.5 and 2% and being substantially free of polymeric material.

14. The method as in claim 13, wherein said mandrel is made from polyethylene.

15. The method as in claim 13, wherein said mandrel is made from ethylene-propylene copolymer.

16. The method of claim 13, wherein the said mandrel is a polymeric material having a melting temperature less than 400° C.

* * * * *